United States Patent [19]

Savit

[11] 4,194,342

[45] Mar. 25, 1980

[54] FOLDED PAPER EDGE OPENING PROCESS

[75] Inventor: Joseph Savit, Glencoe, Ill.

[73] Assignee: AES Technology Systems, Inc., Elk Grove Village, Ill.

[21] Appl. No.: 946,347

[22] Filed: Sep. 27, 1978

[51] Int. Cl.[2] ..... B65B 43/26; B65B 69/00

[52] U.S. Cl. ..... 53/492; 83/912

[58] Field of Search ..... 53/492, 381 R, 382, 53/384; 162/158; 83/912; 432/230; 156/645, 152, 2, 236, 247

[56] References Cited

U.S. PATENT DOCUMENTS

| | | | |
|---|---|---|---|
| 2,032,645 | 3/1936 | Youtz | 162/158 X |
| 2,866,589 | 12/1958 | Zacker | 206/612 X |
| 2,992,629 | 7/1961 | Belopavlovich, Jr. | 53/381 R X |
| 3,116,718 | 1/1964 | Krupotich et al. | 53/381 R |
| 3,132,629 | 5/1964 | Krupotich | 53/381 R |
| 3,677,460 | 7/1972 | Whitman | 53/381 R X |
| 3,815,325 | 6/1974 | Berger | 53/381 R |
| 3,871,573 | 3/1975 | Whitman | 206/601 |
| 4,069,011 | 1/1978 | Gunther, Jr. | 432/230 |

*Primary Examiner*—Horace M. Culver

*Attorney, Agent, or Firm*—Dressler, Goldsmith, Clement, Gordon & Shore

[57] ABSTRACT

A process is provided for the opening of envelopes made of cellulosic paper in which there is applied to at least one envelope edge as the sole reactant with the cellulose therein a non-noxious organic acid having at least one pK value at room temperature between about 1.5 and about 5, followed by the application of heat and mild mechanical action to the envelope edge.

12 Claims, No Drawings

FOLDED PAPER EDGE OPENING PROCESS

BACKGROUND OF THE INVENTION

In organizations receiving large amounts of mail, the opening of envelopes constitutes a substantial burden. To deal with this burden, mechnical envelope openers have been used which operated by cutting a thin strip from one edge of each envelope. Such openers sometimes damage the envelope contents because of variations in envelope size and the manner in which the contents are stuffed in the envelopes. Mechanical openers also produce large volumes of paper shavings from the high speed cutting of envelopes.

It has also been proposed to open envelopes by processes involving the chemical degradation of paper, and specifically of its cellulose, at at least one edge of the envelopes, and preferably at three edges thereof, followed by mild mechanical action to remove the degraded paper.

Zacker U.S. Pat. No. 2,866,589 discloses the degradation or cellulosic paper envelopes at their edges by chemical reagents, specifically by the action of nitric acid, sodium hydroxide, or sodium hypochlorite, or by the action of sulfuric acid followed by the application of heat. These materials are caustic on contact to human skin and/or produce noxious fumes. Their use within a confined space and the handling of the envelopes after chemical degradation are therefore hazardous, particularly with unskilled personnel.

Whitman U.S. Pat. No. 3,871,573 teaches the utilization of successive applications to the edges of an envelope of a sodium alkyl sulfate and an organic acid, such as oxalic acid or acetic acid, followed by the application of heat. Gunther, Jr. U.S. Pat. No. 4,069,011 discloses a similar system, utilizing tartaric acid in combination with the sodium alkyl sulfate. These systems produce sulfuric acid in situ and are also hazardous to use because of the sulfuric acid fumes produced and because residual sulfuric acid on the envelopes can be harmful to the hands in the subsequent handling of the envelopes. In addition, the sodium alkyl sulfate is a relatively expensive material and the two-stage application is more complex than a single chemical application. Finally, the production of sulfuric acid in the process is corrosive to the equipment used.

BRIEF SUMMARY OF THE INVENTION

In accordance with the present invention, it has been found that caustic or hazardous reagents, whether applied as such or produced in situ, can be totally avoided and that adequate chemical degradation on cellulosic paper can be obtained by the action, as the sole reactant with cellulose, of a non-noxious organic acid having at least one pK value at room temperature between about 1.5 and about 5. The chemical action of the organic acid is assisted by the application of heat; and the envelopes with edges degraded, are then opened by mild mechanical action.

The preferred organic acid is tartaric acid which has a pK value of 2.98 for its first acidic hydrogen atom and a pK value of 4.34 for its second.

In accordance with this invention the organic acid is applied to at least one edge, and preferably to three edges of each envelope in an aqueous solution. The aqueous solution contains no other reactant with cellulose. The invention does, however, contemplate that the aqueous solution may preferably contain one or more constituents to enhance its ability to penetrate into the paper at the envelope edges. The solution may, for example, contain from zero to 50 volume percent, or more, of isopropyl alcohol, and may also contain minor amounts of one or more surfactant materials which are stable in an acidic environment. A preferred organic acid solution is one comprising about 3 normal tartaric acid in a solvent comprising 70 volume percent of water and 30 volume percent of isopropyl alcohol and optionally containing one drop per 100 cc. of a fluorinated surfactant.

The strength of the acid in the solution may be varied within broad limits. Tartaric acid is soluble in aqueous solutions at room temperature up to about 7 normal, but increased concentration above about 3 normal does not appear to improve the effect of the solution in the chemical degradation of cellulose. Furthermore, highly concentrated tartaric acid solutions tend to clog spray nozzles when the acid solution is applied by spray and tend to corrode equipment. At the lower end of the range, concentrations as low as about 0.5 normal may be used, but are not as effective as 3 normal and require longer heating periods and/or higher temperatures in the heating step. Since the solvent of the organic acid solution evaporates when the envelope edge is heated, dilute solutions, if not effective per se, concentrate to solutions which are effective.

Generaly, concentrations of organic acids from about 0.5 to about 7 normal may be used; and the preferable range is from about 2 to about 4 normal.

The acid solution is preferably applied to the envelope edges while the envelopes are clamped, or held, together in stacks so that the edges of a plurality of envelopes define a plane.

The organic acid solution is preferably applied to the edges of the stacked envelopes in the form of a spray applied through spray nozzles in a manner known in the art. The acid solution may also be applied to the edges of the stacked envelopes by the operation of brushes or rollers, or by dipping the edges into a shallow pan containing the solution.

The organic acid solution is generally applied to the envelope edges while both the solution and the envelope edges are at room temperature. If desired, however, either the solution, or the envelope edges, or both, may be preheated to facilitate penetration of the solution into the paper at the envelope edges in those instances where penetration might otherwise be a problem.

After the organic acid solution is applied to the envelope edges, the edges are heated to dry the solution and to promote the degradation of the cellulose making up the paper edges. Heat may be applied by direct contact of the envelope edges with a heated surface, by close proximity of the envelope edges to a source of radiant heat, by directing a heated air stream against the envelope edges, or by inserting and maintaining the stacked envelopes in an oven. In the last named case, the heating is, of course, general, covering the entire envelope and its contents; and this method is not preferred.

The temperature obtained on the outer surface of the envelope edges remains relatively low as long as there is solvent thereon by reason of the cooling effect of the solvent evaporation. After the solvent has evaporated the temperature at the outside of the envelope edges may range from about 80° C. to just below the temperature at which the paper would ignite. Most envelopes are made of starch-filled papers; and the edges of envelopes made of such papers may be heated to temperatures as high as 230° C. without igniting. Within the foregoing range, the desired chemical degradation will, of course, proceed much more quickly at higher temperatures than at the lower end of the range.

The temperature at the envelope edges may be measured, if desired, by an optical pyrometer, or other remote temperature measuring device by techniques known in the art. However, precise temperature control is not essential, except when temperatures close to the ignition temperature are employed.

After the heating step, the edges of the stacked envelopes are subjected to a mild mechanical action to remove the degraded and embrittled cellulose and thereby unseal the edges. The mild mechanical action may be by abrasion, as with a brush or wheel , or may be by the action of a high velocity air stream.

The process of this invention may be applied to only one edge of each rectangular envelope. It may also be applied to two, three, or all four edges. Preferably, it is applied to three edges, leaving intact either the edge joining the envelope flap to the envelope body or the edge opposite the flap.

In most instances, the removal of envelope contents from envelopes opened as described above will be a manual or automatic operation on each individual envelope. This is necessary because in most cases it is desired to be able to relate an envelope with its contents, if necessary.

EXAMPLES

For test purposes and to determine the effectiveness of the cellulose degradation at an envelope edge, a test device was constructed. The device comprised a spring dynamometer suspended from a firm base, having a horizontal bar suspended at one of its ends from the lower end of the dynamometer and a vertical bar suspended from the opposite end of the horizontal bar.

In the testing, a side of each test envelope was slit open and the interior of the envelope was placed over the horizontal bar, with the horizontal bar lying just under the interior of one uncut edge of the envelope and the vertical bar lying adjacent the interior of another uncut edge.

About 0.025 cc. of one of the test solutions listed below was then applied to the upper edge of each envelope (the side above the horizontal bar) for a period of 10 seconds and the upper edge was then heated by contact with a heating strip for a period of 15 seconds to a temperature shown in the Table below. The temperatures were observed both at the exterior of the upper edge of each envelope and at the interior of each envelope just below the inner surface of the upper edge (and above the horizontal bar). The exterior temperature was measured by a surface probe applied to the heating strip which was in contact with the exterior surface of the upper edge of the envelope.

After the heating step, the envelope was pulled downwardly by hand until the upper edge opened and the envelope slipped off the device while the readings on the dynamometer at the instant of opening were observed. Tests in which the treated envelope edge opened under a dynamometer reading of 500 grams or less were considered to be successful with respect to the achievement of ease of opening.

TABLE

| Exp. No. | Acid and Normality | pH | Temperature °C. Outside Envelope | Temperature °C. Inside Envelope | Force to Open-gm. |
|---|---|---|---|---|---|
| 1 | 2N Tartaric | 1.55 | 260° | 143° | 150 |
| 2 | 2N Tartaric | 1.55 | 232° | 127° | 100 |
| 3 | 2N Tartaric | 1.55 | 204° | 104° | 200 |
| 4 | 2N Tartaric | 1.55 | 182° | 100° | 375 |
| 5 | 2N Tartaric | 1.55 | 154° | 88° | 500+ |
| 6 | 2N Tartaric | 1.55 | 127° | 74° | 500+ |
| 7 | 2N Pyruvic | 1.25 | 204° | 100° | 500+ |
| 8 | 2N Pyruvic | 1.25 | 232° | 113° | 250 |
| 9 | 2N Pyruvic | 1.25 | 210° | 107° | 350 |
| 10 | 2N Pyruvic | 1.25 | 188° | 104° | 500 |
| 11 | 2N Pyruvic | 1.25 | 154° | 91° | 500+ |
| 12 | 2N Citric | 1.80 | 204° | 110° | 450 |
| 13 | 2N Citric | 1.80 | 188° | 96° | 500+ |
| 14 | 2N Citric | 1.80 | 188° | 99° | 500+ |

In addition to the foregoing, successful results were also obtained using acetic acid, succinic acid, maleic acid, malic acid and malonic acid as the organic acid which is the sole reactant with the cellulose of the paper envelope.

Other suitable organic acids are acids composed of carbon, hydrogen and oxygen atoms which are considered to be safe for human ingestion as recognized by their inclusion in the GRAS (generally recognized as safe) list of the United States Food and Drug Administration, as listed in 21 CFR 182 and 184. These acids include (in addition to some of the acids already listed above) adipic acid, lactic acid, propionic acid and benzoic acid.

When the organic acid-treated envelope edges are heated, fumes are produced; and the method of this invention will ordinarily be carried out under a forced ventilation hood. However, the fumes produced from the heating of tartaric acid-treated paper contain the same components as the fumes produced from the normal combustion of untreated paper; and the burning of paper, under normal precautions, has been carried out with safety for hundreds of years.

The gaseous fumes produced by the process of this invention contain minor amounts of toxic materials, such as formaldehyde, acetaldehyde, and acetone which are also natural products of paper combustion. The amounts produced are small, however, and these substances are detected by their odors at concentrations far below the point at which they present a hazard.

Furfural is a major component of the combustion of paper treated with tartaric acid solutions. The Kirk-Othmer Encyclopedia of Chemical Technology (2nd ed. Interscience Publishers Division of Wiley & Sons, Inc., Vol. 10, p. 243 [1966]) states that many years of practical experience demonstrates conclusively that under ordinary plant conditions the use of furfural is not hazardous to the health of employees.

It is contemplated that the foregoing method will find its greatest applicability in the opening of envelopes as described above. It will be obvious, however, that it is applicable to any severing of cellulosic paper at a folded edge thereof. It is applicable, for example, to separate the segments of a fanfold from each other at the folded edges thereof, treating the folded edges in the manner described above for treating the edges of an envelope.

The invention has been described with respect to its preferred embodiments. Those skilled in the art will understand that other variations and modifications may be employed without departing from the essence of this invention.

What is claimed is:

1. In the method of opening envelopes made of cellulosic paper in which at least one chemical reagent is applied to at least one edge of each envelope followed by the application of heat and mild mechanical action thereto, the improvement wherein said chemical reagent comprises as the sole reactant with cellulosic paper a non-noxious organic acid having at least one pK value at room temperature between about 1.5 and about 5.

2. The method of claim 1 wherein said acid is tartaric acid.

3. The method of claim 1 wherein said acid is citric acid.

4. The method of claim 1 wherein said acid is succinic acid.

5. The method of claim 1 wherein said acid is pyruvic acid.

6. The method of claim 1 wherein said acid is malonic acid.

7. The method of claim 1 wherein said acid is applied in a liquid medium comprising water and at least one constituent to enhance the penetration of the liquid medium into the paper at the envelope edge.

8. The method of claim 7 wherein said penetration enhancing constituent is isopropyl alcohol.

9. The method of claim 8 wherein said liquid medium comprises from 0.5 to 7 normal tartaric acid in a liquid medium comprising from zero to 50% of water and from zero to 50% of isopropyl alcohol.

10. In the method of opening envelopes made of cellulosic paper in which at least one chemical reagent is applied to at least one edge of each envelope followed by the application of heat and mild mechanical action thereto, the improvement wherein said chemical reagent comprises as the sole reactant with cellulosic paper tartaric acid at a concentration between about 2 normal and about 4 normal in a liquid medium comprising about 30 volume percent of isopropyl alcohol and about 70 volume percent of water.

11. The method of claim 1 wherein said heating step produces a temperature at the outer surface of the envelope edge between about 80° C. and about 230° C.

12. In the method of severing cellulosic paper at a fold therein in which at least one chemical reagent is applied to said fold followed by the application of heat and mild mechanical action thereto, the improvement wherein said chemical reagent comprises as the sole reactant with cellulosic paper a non-noxious organic acid having at least one pK value at room temperature between about 1.5 and about 5.

* * * * *